US011708259B2

(12) United States Patent
Lukac et al.

(10) Patent No.: US 11,708,259 B2
(45) Date of Patent: Jul. 25, 2023

(54) ALCOHOL CONCENTRATE FILLING SYSTEMS AND METHODS OF USE THEREOF

(71) Applicant: Bedford Systems LLC, Bedford, MA (US)

(72) Inventors: Jure Lukac, Bučečovci (SI); Stanko Zver, Bučečovci (SI); Justin Robbins, Bedford, MA (US); Peter Edwards, Bedford, MA (US)

(73) Assignee: Bedford Systems LLC, Bedford, MA (US)

( * ) Notice: Subject to any disclaimer, the term of this patent is extended or adjusted under 35 U.S.C. 154(b) by 0 days.

(21) Appl. No.: 16/549,758

(22) Filed: Aug. 23, 2019

(65) Prior Publication Data

US 2020/0062571 A1 Feb. 27, 2020

Related U.S. Application Data

(60) Provisional application No. 62/722,822, filed on Aug. 24, 2018.

(51) Int. Cl.
*B67D 1/08* (2006.01)
*B67D 1/00* (2006.01)

(52) U.S. Cl.
CPC ..... *B67D 1/0884* (2013.01); *B67D 1/0004* (2013.01); *B67D 1/0076* (2013.01); *B67D 1/0857* (2013.01); *B67D 2210/00104* (2013.01)

(58) Field of Classification Search
CPC .. B67D 1/0884; B67D 1/0076; B67D 1/0004; B67D 1/0857; B67D 2201/00104;
(Continued)

(56) References Cited

U.S. PATENT DOCUMENTS 3,477,192 A 11/1969 Brown et al.
3,664,086 A 5/1972 James et al.
(Continued)

FOREIGN PATENT DOCUMENTS

CN 1492823 A 4/2004
CN 1966390 A 5/2007
(Continued)

OTHER PUBLICATIONS

International Search Report and Written Opinion for PCT Application No. PCT/US2019/047960, dated Nov. 14, 2019.

*Primary Examiner* — Lien M Ngo
(74) *Attorney, Agent, or Firm* — Bedford Systems LLC

(57) ABSTRACT

Disclosed herein are systems and methods for inducing a substantially non-hazardous atmosphere encompassing a beverage container during filling, such as filling a small volume container with an alcohol product. A multi-tiered approach can be used to reduce the combustibility of the atmosphere encompassing the beverage container. For example, a ventilation module can be provided and configured to dilute vapors of the beverage liquid. Further, a chilling module can be provided and configured to reduce or maintain a reduced temperature of the beverage liquid. Further, a capture module can be provided and configured to dilute stray beverage liquid. The ventilation module, the chilling module, and the capture module can cooperate to define a non-hazardous zone encompassing the beverage container. This can allow non-hazardous rated electrical components to operate proximate and within the atmosphere associating the alcohol product during filling.

24 Claims, 8 Drawing Sheets

(58) Field of Classification Search
CPC ..... B65B 31/02; B65B 63/08; B65B 3/18; B67C 7/00; B67C 2003/2694
USPC ..... 53/471, 510, 283, 266.1, 269, 432
See application file for complete search history.

(56) References Cited

U.S. PATENT DOCUMENTS

| | | | | |
|---|---|---|---|---|
| 5,299,408 | A * | 4/1994 | Dupont | B67B 1/04 53/109 |
| 5,896,727 | A | 4/1999 | Egli et al. | |
| 6,457,299 | B1 * | 10/2002 | Schwenke | B65B 31/025 53/110 |
| 6,705,062 | B1 | 3/2004 | Varlet | |
| 7,147,675 | B2 * | 12/2006 | Erhardt | H01M 50/60 29/623.1 |
| 7,685,796 | B2 * | 3/2010 | Capelli | B67C 3/222 53/510 |
| 8,807,392 | B2 | 8/2014 | Smeller et al. | |
| 9,056,689 | B2 | 6/2015 | Rasmussen et al. | |
| 9,433,315 | B2 * | 9/2016 | Hotaling | A47J 31/4428 |
| 9,623,383 | B1 | 4/2017 | Kleinrichert | |
| 9,630,826 | B2 | 4/2017 | Green et al. | |
| 10,111,554 | B2 | 10/2018 | Roberts et al. | |
| 10,252,900 | B2 | 4/2019 | Cook | |
| 10,524,609 | B2 | 1/2020 | Schuh et al. | |
| 2007/0214748 | A1 | 9/2007 | Dovesi | |
| 2009/0126323 | A1 | 5/2009 | Kelley et al. | |
| 2010/0139709 | A1 | 6/2010 | Saefkow et al. | |
| 2012/0058230 | A1 | 3/2012 | Rasmussen et al. | |
| 2013/0129870 | A1 | 5/2013 | Novak et al. | |
| 2014/0212542 | A1 | 7/2014 | Minhas | |
| 2014/0290181 | A1 | 10/2014 | Edwards et al. | |
| 2014/0331868 | A1 | 11/2014 | Novak et al. | |
| 2014/0334868 | A1 | 11/2014 | Apfel | |
| 2015/0248804 | A1 | 9/2015 | Hannawa et al. | |
| 2016/0152458 | A1 * | 6/2016 | Clusserath | B67C 3/2628 53/432 |
| 2017/0158361 | A1 | 6/2017 | Desoutter | |
| 2018/0155176 | A1 | 6/2018 | Cook | |

FOREIGN PATENT DOCUMENTS

| | | | |
|---|---|---|---|
| CN | 102951588 | A | 3/2013 |
| CN | 106143967 | A | 11/2016 |
| CN | 106395714 | A | 2/2017 |
| CN | 107444683 | A | 12/2017 |
| CN | 206767616 | U | 12/2017 |
| CN | 107902155 | A | 4/2018 |
| EP | 0050333 | A2 | 4/1982 |
| EP | 0050333 | B1 | 7/1986 |
| EP | 0457747 | A1 | 11/1991 |
| EP | 1787940 | B2 | 4/2013 |
| EP | 3000776 | A1 | 3/2016 |
| WO | 2022038408 | A1 | 2/2022 |

* cited by examiner

ALCOHOL CONCENTRATE FILLING SYSTEMS AND METHODS OF USE THEREOF

CROSS-REFERENCE TO RELATED APPLICATIONS

This patent application is a non-provisional patent application of, and claims priority to, U.S. Provisional Application No. 62/722,822 filed Aug. 24, 2018, and titled "ALCOHOL CONCENTRATE FILLING SYSTEMS AND METHODS OF USE THEREOF," the disclosure of which is hereby incorporated by reference in its entirety.

FIELD

The described embodiments relate generally to alcohol filling systems and methods of use thereof. And more particularly, the present embodiments relate to systems and methods for hazard mitigation of alcohol filling systems.

BACKGROUND

Alcohol can be susceptible to combustion based on a variety of environmental conditions. Many traditional systems for filling containers with alcohol can suffer from significant drawbacks that affect a risk of combustion and overall process safety. An increased risk of combustion can mandate the use of certain electrical equipment that can operate in such an environment, such as equipment that is spark-proof, among other requirements. Electrical components rated for operation in hazardous or otherwise combustible environments can increase the cost and complexity of associated filling systems, thereby limiting the adaptability of such filling systems to particular manufacturing environments. As such, the need continues for improved approaches to mitigate hazardous conditions for alcohol filling systems.

SUMMARY

A beverage container can be filled with a beverage liquid, such as alcohol or other substance that can create a combustible environment. For example, the beverage liquid can emit vapor or produce stray fluid (spills) during filling, which can increase the combustibility of an atmosphere. Electrical components and other equipment associated with the filling would traditionally have a hazardous area classification or other rating that allows the components or equipment to operate in a combustible environment, such as a rating that certifies spark-proof characteristics, and so on. However, relying on components that all have such rating can be costly, and can increase system complexity to beyond practical operating requirements. For example, filling an assembly of small-volume beverage containers, such as those described herein, with various alcohol products involves numerous electromechanical systems and subsystems, which rely on electrical controls and indicators. Certifying all such components for a hazardous area classification could be impractical, potentially limiting the diversity of manufacturing settings where such filling could occur.

The examples described herein operate to reduce the combustibility of the atmosphere encompassing the beverage container during filling. For example, multiple modules can operate together, to induce a substantially non-hazardous zone encompassing the beverage container during filling. The non-hazardous zone can be defined as having a substantially incombustible atmosphere such that unrated electrical components can operate therein with low, very low, or virtually no risk of combustion. As such, a greater variety and combination of electrical components and systems can be used in combination to fill the beverage container, despite potential combustible vapors and spills emanating from the alcohol product, and the combustibility of the alcohol product itself.

While many examples are described herein to facilitate the inducement of a substantially non-hazardous environment, according to one example, a system for providing a combustible beverage liquid to a beverage container is disclosed. The system includes a ventilation module configured to dilute vapors of the beverage liquid. The system further includes a chilling module configured to reduce or maintain a reduced temperature of the beverage liquid. The system further includes a capture module configured to dilute stray beverage liquid. The ventilation module, the chilling module, and the capture module cooperate to define a non-hazardous zone encompassing the beverage container.

In another example, the system further includes electrical components within the non-hazardous zone that can be exposed to an atmosphere associated with the beverage liquid. The electrical components can be unrated for use in a classified hazardous area location.

In another example, the beverage liquid can include an alcohol product having an alcohol concentration of less than 50% ABV. In some cases, the beverage liquid can include a carbonated product having a carbonation level of less than 5.0 g/L.

In another example, the ventilation module includes an enclosure defining a volume of the non-hazardous zone. The ventilation module can further include an air circulation system fluidically coupled with the enclosure adapted to remove vapors from the enclosure. In some cases, the chilling module can be associated with a filling station within the enclosure. The filling station can be adapted to provide the beverage liquid to the beverage container at the reduced temperature. The reduced temperature of the beverage liquid can be below a flash point temperature of the beverage liquid.

In another example, the capture module can include a catch within the enclosure configured to collect the stray beverage liquid. The capture module can further include a flush adapted to provide a diluent to the catch for diluting the stray beverage liquid. The capture module can further include an exit for removing a combination of the diluent and the stray beverage liquid from the non-hazardous zone.

In another example, a method for providing a combustible beverage liquid to a beverage container is disclosed. The method includes filling the beverage container with the beverage liquid. The method further includes inducing a non-hazardous zone encompassing the beverage container during the operation of filling. Inducing the non-hazardous zone includes maintaining the beverage liquid at a temperature below a flash point temperature of the beverage liquid using a chilling module, such as any of the chilling modules and variations thereof described herein. Inducing the non-hazardous zone further includes diluting vapors of the beverage liquid associated with the operation of filling the beverage container using a ventilation module, such as any of the ventilation modules and variations thereof described herein. Inducing the non-hazardous zone further includes diluting stray beverage liquid associated with the operation of filling the beverage container using a capture module, such as any of the capture module and variations thereof described herein.

In another example, the method can further include providing the beverage container. The beverage container can have a volume of less than 350 ml. In some cases, the method can further include sealing the beverage liquid within the beverage container within the non-hazardous zone.

In another example, the method further includes operating one or more unrated electrical components proximate the beverage container during the operation of filling. In some cases, the beverage liquid can include one or both of a beer concentrate or a cocktail concentrate.

In another example, the operation of diluting vapors can include inducing air flow traversing the beverage liquid during the operation of filling, wherein the air flow is adapted to carry the vapors away from the beverage container. Additionally or alternatively, the operation of diluting the stray beverage liquid can include inducing a liquid flow traversing a catch below the beverage container, where the catch includes the stray beverage liquid therein. The liquid flow can be adapted to carry the stray beverage liquid away from the beverage container.

In another example, a system for providing a combustible beverage liquid to a beverage container is disclosed. The system includes an enclosure adapted for forced ventilation and stray fluid exit. The system further includes a conveyance mechanism configured to route an assembly of beverage containers through the enclosure. The system further includes a filling station within the enclosure, the filling station being configured to provide the beverage liquid to a beverage container of the assembly at or below a flash point temperature of the beverage liquid. The system further includes a capping station within the enclosure, the capping station being configured to seal the beverage liquid within the beverage container. The system further includes electrical components at least partially within the enclosure that are exposed to a common atmosphere associated with the filling station and the capping station.

In another example, the system can further include an air circulation system fluidically coupled with the enclosure for providing the forced ventilation and configured to dilute vapors of the beverage liquid within the enclosure. The system can further include a catch generally arranged below the conveyance mechanism, the catch being configured to collect stray beverage liquid. The system can further include a flush configured to provide a diluent to the catch upon the collection of stray beverage liquid therein, the catch fluidically coupled to the stray fluid exit of the enclosure.

In another example, the electrical components can include a sensor configured to detect a collection of the stray beverage liquid within the catch. The electrical components can include a mass flow meter configured to meter the beverage liquid into the beverage container.

In another example, the system can further include, within the enclosure, a gas blanketing system configured to displace oxygen encompassing or within the beverage container.

In addition to the exemplary aspects and examples described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

Figure 1A:
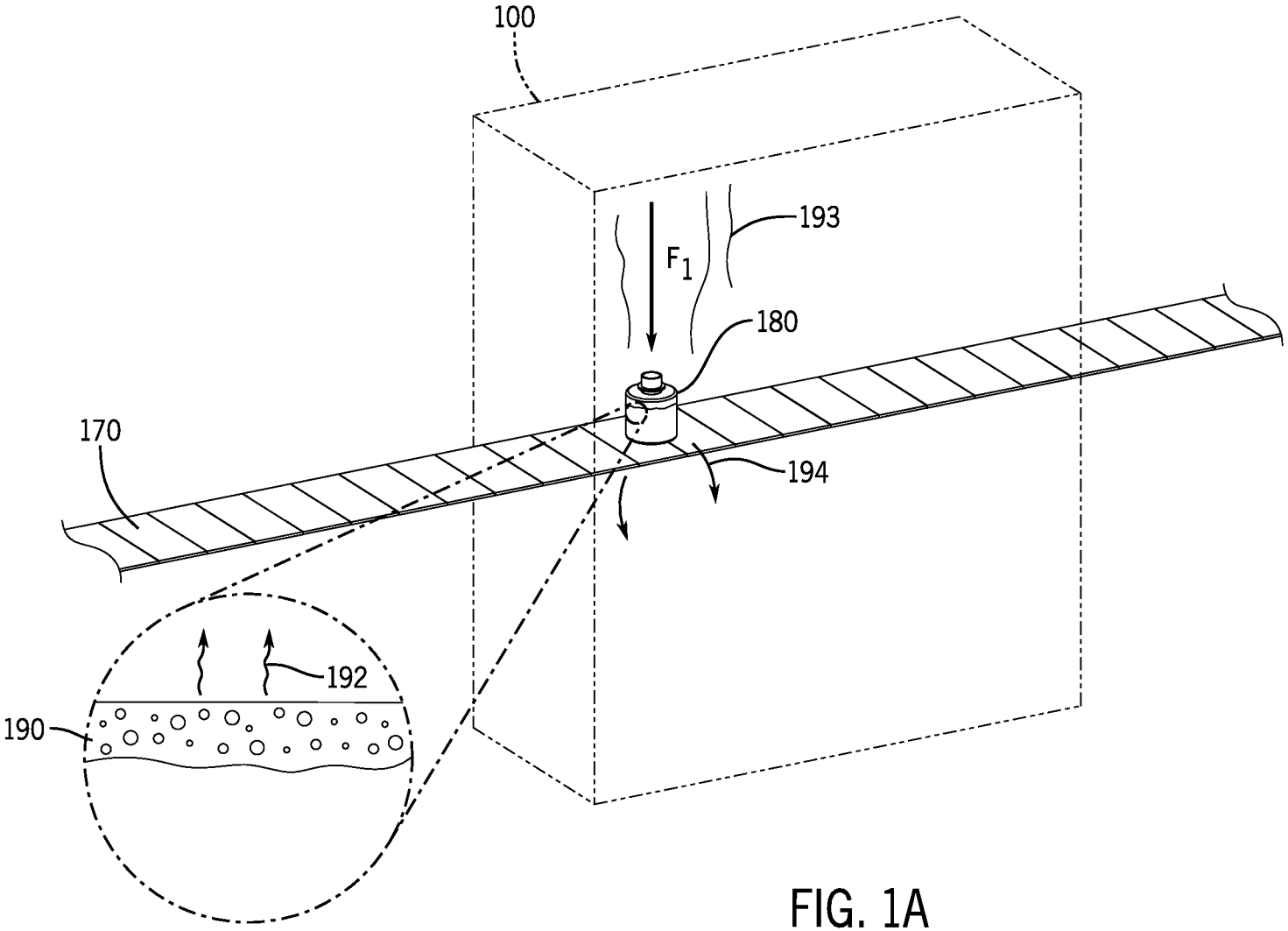
FIG. 1A depicts a beverage container traversing a non-hazardous zone for filling.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various examples described herein and, accordingly, may not necessarily be presented or illustrated to scale, and are not intended to indicate any preference or requirement for an illustrated example to the exclusion of examples described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure describes systems, devices, and techniques related to inducing a substantially non-hazardous environment encompassing the beverage container during filling. A substantially non-hazardous environment, as described herein, can include an atmosphere or volume having a reduced or minimal risk of combustion. For example, a substantially non-hazardous environment can include an atmosphere in which unrated electrical components (e.g., non-spark-proof) electrical components can be safely operated without a substantial risk of combustion. The beverage container can be a small-volume or small-form-factor container that is used to hold a beverage liquid, such as a flammable alcohol product. The beverage container can be used with a beverage machine or other apparatus that produces an alcoholic, possible single-serve, beverage from the contents of the beverage container. Filling the beverage container with an alcohol product can be associated with various risks, including fire, explosion, contamination, and/or other safety concerns. For example, the alcohol product can be susceptible to vapor ignition in and around the product. Spills of stray product can also present a source of combustion.

Disclosed herein is a multi-tiered approach to mitigate the risks associated with filling, and more generally, manipulating and transporting the alcohol product. The multi-tiered approach can implement multiple systems and modules to facilitate redundancy in mitigating potential hazards that can contribute to the combustible atmosphere. With multiple systems and modules operating to reduce the combustibility of the atmosphere, a combinative multiplicative safety benefit can be realized, thus allowing non-hazardous rated electrical components to safely operate in the presence and proximity of a combustible beverage liquid.

To facilitate the foregoing, a system is provided with multiple modules of reducing the combustibility of an atmosphere associated with the beverage liquid. The system can include a ventilation module configured to dilute vapors of the beverage liquid. The system can further include a chilling module configured to reduce or maintain a reduced temperature of the beverage liquid. The system can further include a capture module configured to dilute stray beverage liquid, such as spills that occur during filling. Each of the ventilation module, the chilling module, and the capture module can cooperate to define a non-hazardous zone encompassing the beverage container.

It will be appreciated that a variety of electromechanical components, systems, subsystems, and controls can be used to implement each of the foregoing modules, and various illustrative examples of each are described in greater detail below. Broadly, the ventilation module can be used in conjunction with an enclosure or housing to provide forced air exchange in and around an area used for filling the beverage container with the beverage liquid. For example, the enclosure can define an atmosphere, such as a partially enclosed volume, around a beverage container and one or more components used to provide the beverage liquid to the beverage container. Vapors can be emitted from the beverage product, such as during the transfer of the beverage product into the beverage container. To help avoid accumulation and concentration of these vapors, the enclosure can be associated with one or more air circulation components, including fans, ducting, compressors, and so on that collectively operate to dilute the vapors of the beverage liquid. In some cases, this can involve removing the vapors of the atmosphere defined by the enclosure and/or engaging in a fluid or gas exchange with the atmosphere to displace and dilute any combustible vapors.

Spills of the beverage liquid can also contribute to a combustible environment. Operating along with the ventilation module can be the capture module to facilitate removal of any such spills from the atmosphere or general region around the beverage container and beverage liquid. Broadly, the capture module can operate to provide a diluent, such as water, to spills of the beverage liquid, such as a spill that can occur during filling and/or transport. In one example, the capture module can include a catch, such as a pan, to physically collect any stray beverage liquid. This could be a linear or other surface below, for example, a conveyance mechanism of the filling system. Sensors can operate to detect the presence of stray fluid in the catch. Upon detection and/or at regular or user-programmed intervals, a flush connected with the diluent source can provide a quantity of diluent to the catch, helping to dilute any combustible liquids contained therein. An exit or drain can be fluidically connected to the catch and can be used to route a diluted combination of the stray beverage liquid and the diluent away from the beverage container, such as away from the enclosure and the substantially non-hazardous atmosphere.

The temperature of the beverage liquid itself can also contribute to a combustible atmosphere. In combination with the ventilation and capture modules, the chilling module can operate to reduce or maintain a reduced temperature of the beverage liquid. Specifically, the chilling module can reduce or maintain a reduced temperature of the beverage liquid to below a flash point temperature, such as maintaining the beverage liquid at 1° C., 2° C., or 3° C. or more below the flash point temperature of the beverage liquid. In this regard, the chilling module can include thermal jackets around some or all of the piping and/or bulk containers for the beverage liquid, including active systems which can circulate an active cooling agent or fluid adjacent the beverage liquid to maintain a set temperature. Because the beverage liquid can take a variety of forms, for example, such as various alcohols of varying alcohol content, the chilling system can be adapted to reduce or maintain a reduced temperature of the specific beverage liquid being used to fill a given beverage container.

The beverage containers can be substantially small-volume containers, such as 350 ml or less in volume. Multiple different alcohol products and associated liquids can be used to fill the containers. The containers can be filled as a group, with an assembly, such as a continuous assembly being filled in series or parallel through a high-volume production line. Numerous electrical components can be used to facilitate such production, including, for the sake of non-limiting example, electrical components and connections to operate valves, sensors, indicators, actuators, displays, motors, and the like. According to the examples described herein, a substantially non-hazardous environment is induced in and around the beverage container. Subsequently, the foregoing electrical components need not necessarily be rated for a hazardous area; non-rated electrical components (e.g., non-spark-proof) components can be safely used. As such, the complexity and cost of the overall filling system is substantially reduced. Moreover, the filling system itself can be modular or adaptable for operation in a variety of manufacturing locations, such as locations that would not otherwise include or be capable of adapting to a hazardous area. The systems and method for inducing a non-hazardous environment not only enhance process safety, but can expand the number of facilities capable of filling small-volume containers with a combustible substance, with some of the burdens of doing so being lifted by the described techniques.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, skill, and knowledge of the relevant art, are within the scope of the present inventive aspects.

FIG. 1A depicts a non-hazardous zone 100, such as the non-hazardous zone discussed above and described in greater detail below. The non-hazardous zone 100 is shown as encompassing a beverage container 180 during filling. For example, the beverage container 180 can receive a flow of beverage liquid $F_1$ substantially within and encompassed by the non-hazardous zone 100.

As described herein, the non-hazardous zone 100 can have or define a reduced-combustion environment. As such, the non-hazardous zone 100 can include electrical components or other features that can be unrated for a hazardous area. For example, considering the National Electric Code of the United States, the electrical components of the non-hazardous zone need not have a Class 1, Division 1 rating, which is the most severe or protective rating used for electrical components that are exposed to a combustible environment. For example, the systems and techniques described herein can reduce the combustible potential of the atmosphere encompassing the beverage container so that electrical components of less severe ratings can be used, such as those having a Class 1, Division 2 rating or that are otherwise generally unclassified (e.g., non-spark-proof) components. For example, the systems and techniques described herein can cooperate to dilute hazardous gas to a concentration of 25% of its lower flammability unit, or other appropriate concentration so that such electrical components can operate safely within the non-hazardous zone 100.

In the context of FIG. 1A, the non-hazardous zone 100 is shown encompassing a beverage container 180 that is arranged on a conveyance mechanism 170. The conveyance mechanism 170 can be a belt, a pusher, a conveyor, or another mechanism that advances the container to a filling station within the non-hazardous zone 100. Within the non-hazardous zone 100, the beverage container 180 can receive a beverage liquid 190 along the flow $F_1$. The beverage liquid 190 can be an alcohol product, such as an alcohol product having an alcohol concentration of at least 10% ABV, at least 30% ABV, or at least 50% ABV, among other possibilities. The beverage liquid 190 can also be carbonated, such as having a carbonation level of at least 1.0 g/L, at least 3.0 g/L, or at least 5.0 g/l, among other possibilities.

Associated with the filling of the beverage container 180, as shown in FIG. 1A, the beverage liquid 190, left unmitigated, could contribute to a hazardous atmosphere. For example, the beverage liquid 190 could produce flammable vapors, such as vapors 192 within the beverage container 180 and/or vapors 193 outside of the beverage container 180. Additionally or alternatively, at least some of the beverage liquid 190 could be spilled, resulting in stray beverage liquid in a region around the beverage container 180, such as the stray flow 194 shown in FIG. 1A. As described herein in greater detail with respect to FIGS. 2-4, the systems and techniques disclosed operate to mitigate the potential hazards associated with the vapors 192, 193, and the stray flow 194, including using various dilute-based techniques to establish and maintain the non-hazardous zone encompassing the beverage container 180 during filling.

Figure 1B:
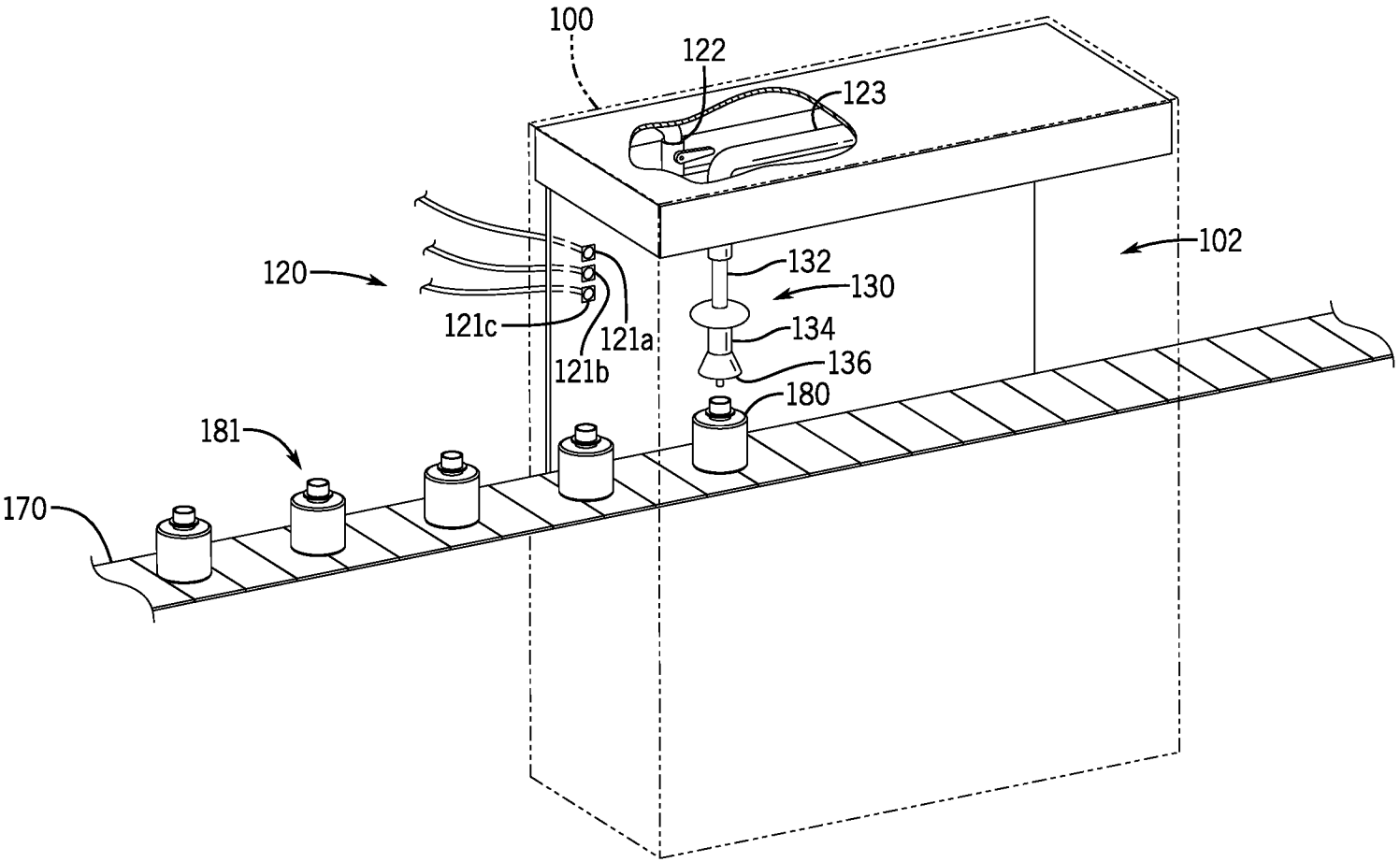
FIG. 1B depicts the non-hazardous zone of FIG. 1A including electromechanical components associated with filling an assembly of beverage containers with an alcohol product.

Mitigating hazards associated with the beverage liquid 190 can allow the non-hazardous zone 100 to include electrical components that are not rated for a hazardous or otherwise combustible environment. With reference to FIG. 1B, the non-hazardous zone 100 is shown including various illustrative electromechanical components to facilitate filling the beverage container 180 with the beverage liquid 190, including such unrated electrical components therein. For example, FIG. 1B shows electrical components 120 within the non-hazardous zone 100, such as within an atmosphere 102 defined by a volume of the non-hazardous zone 100. The electrical components 120 can generally be substantially any components that can be used with filling the beverage container 180, including an illustrative switch 121*a*, an illustrative indicator 121*b*, and an illustrative sensor 121*c*. In other cases, other electrical components can be provided to facilitate filling the beverage container 180. The electrical components 120 can be unrated for a hazardous zone, and thus can, in certain circumstances, be non-spark-proof components.

FIG. 1B also shows various other electromechanical components to facilitate filling the beverage container 180 with a beverage liquid 190. Broadly, this can include a collection of valves 122 and piping 123 that can operate to transport and optionally meter the beverage liquid from a region outside of the non-hazardous zone 100 to the atmosphere 102 for dispensing into the beverage container 180. As such, the collection of valves 122 and piping 123 can be partially positioned within the atmosphere 102 and can be operably associated with electrical components to facilitate each component's respective operation, including various electrical actuators and cooling systems, which can use non-hazardous rated electrical components, according to the examples described herein.

Within the non-hazardous zone 100 can also be a filling station 130. The filling station 130 can be adapted to deliver beverage liquid 190 to individual beverage containers 180 of an assembly of beverage container 181. For example, the assembly of beverage container 181 can be advanced into the non-hazardous zone 100, for example, via the conveyance mechanism 170, and upon arriving at or near the filling station 130 can be arranged to receive the beverage liquid, which can be a combustible substance. In this regard, while the filling station 130 can include a variety of components, in the illustration of FIG. 1B, the filling station 130 can include an arm 132, a main portion 134, and a nozzle 136. In one example operation, the arm 132 can structurally support the filling station 130 within the non-hazardous zone 100 and/or fluidically connect the filling station 130 to internal or external components associated with the delivery of the beverage liquid, such as the collection of valves 122 and pipes 123 described above. The main portion 134 can be actuateable, including being moveable axially, relative to the arm 132. As such, a beverage container 180 can be advanced relative to the filling station 130, and the main portion 134 can be engaged to advance at least partially toward the beverage container 180 for delivery of the beverage liquid thereto. The nozzle 136 can include a delivery mechanism for routing the beverage liquid from the filling station 130 toward and into the beverage container 180. In some cases the nozzle 136 and/or another component of the filling station 130 can operate to meter the flow of the beverage liquid, such as including or being coupled to a volumetric and/or mass flow meter to initiate the flow of the beverage liquid into the beverage container 180, and to stop a flow of the beverage liquid once a threshold quantity of the beverage liquid has been delivered to the beverage container 180.

As illustrated by the foregoing, the filling station 130 uses electrical components to provide the beverage liquid to the beverage container 180. For example, electrical components for actuating, measuring, or cooling, among other functions, can be used. The examples described herein allow these electrical components to be unrated for a combustible environment. This can simplify and streamline the systems used for filling the beverage container 180, while reducing cost and expanding the adaptability of the system to different manufacturing environments.

Figure 2:
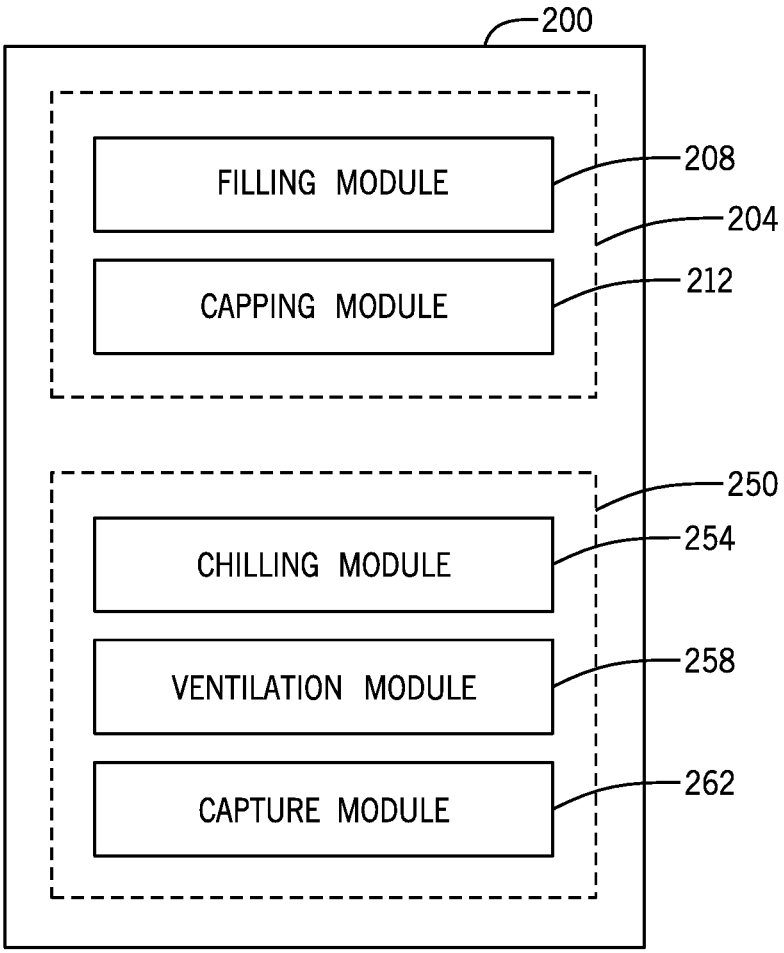
FIG. 2 depicts a functional diagram of a filling system.

For example, FIG. 2 depicts a functional diagram of a system 200 that can be used to induce a non-hazardous zone encompassing a beverage container. Broadly, the system 200 can be configured to reduce or otherwise maintain a beverage liquid at a reduced temperature. The system 200 can be further configured to dilute air in an atmosphere around the filling of the small-form-factor beverage container, such as by forced convection. The system 200 can be configured to dilute spills, such as those captured by capture assembly. Taken in combination, temperature control, dilution of air, and dilution of spills allows the small-form-factor beverage containers to be filled in a manner that has a substantially low risk of combustion. Because the risk is lower, instrumentation, controls, procedures, and so on can be modified accordingly.

To facilitate the foregoing, the system 200 can include various modules or collections of mechanical components, instruments, and so on that collectively operate to perform the functions described herein. Rather than define discrete or separated mechanical components and instruments, it will be appreciated that the modules can use common or overlapping components and instruments to perform the various functions described herein. For example, a given pump, valve, vessel, electrical component, structural support, and/or other element can be used to perform functions of multiple modules. Accordingly, the modules described with respect to FIG. 2 are used to facilitate an understanding of the system 200, and are not meant as demarcating specific mechanical components or instruments as performing discrete functions.

In the example of FIG. 2, the system 200 is shown as including production modules 204 and safety modules 250. The production modules 204 can relate to the electromechanical components used to provide the beverage liquid to the beverage container. While many modules are possible and contemplated herein, the production modules 204 of FIG. 2 are shown as including a filling module 208 and a capping module 212. The filling module 208 can generally operate to provide beverage liquid to the beverage containers. For example, various pumps, vessels, flow meters, valves, and so on can cooperate to dispense a precision-controlled amount of beverage liquid, such as a combustible alcohol product, into the beverage container. As one possibility, a mass and/or volumetric flow meter can be used to identify an amount of liquid provided to the beverage container, and a control valve can provide a gating function to control a flow of the beverage liquid (e.g., such as ceasing the flow when an identified beverage container is adequately filled, and resuming the flow when a subsequent beverage container is advanced for filling).

The capping module 212 can operate to install a lid, a cap, or another feature that seals the internal volume of the beverage container from an external environment, such as an atmosphere defined by the non-hazardous zone 100. In some cases, this can involve advancing a plug or another feature into an opening at a top of the beverage container. In conjunction with the sealing of the beverage container, nitrogen or another gas can be introduced in a head space of the beverage container, for oxygen removal, in certain applications.

For example, in conjunction with filling and/or capping of the beverage container with the beverage liquid, the system 200 can be operable to conduct an oxygen purge of the beverage container, which can be beneficial for sanitation and/or hazard mitigation. As one example, a selected portion of the volume of the beverage container can be filled with nitrogen, or another gas, in order to displace the oxygen from the beverage container internal volume. This purge can be repeated multiple times, such as two or three times, in order to flush the oxygen from the beverage container. In some cases, this oxygen purge can occur at substantially the same time as the filling of the beverage container with the alcohol product; however, this is not required.

The system 200 is also shown with various safety modules 250. The safety modules 250 include systems and techniques that cooperate to induce the non-hazardous environment encompassing the beverage liquid filling of the production modules 204. As an illustration, the safety modules 250 can include a chilling module 254, a ventilation module 258 and a capture module 262. The chilling module 254, the ventilation module 258, and the capture module 262 cooperate to induce the non-hazardous environment, producing a multi-tiered approach the combustible atmosphere reduction, allowing for redundancy the facilities use of unrated electrical components adjacent and proximate the beverage liquid.

For example, the chilling module 254 can operate to reduce or maintain a reduced temperature of the beverage liquid as the beverage liquid is advanced for filling into the beverage container. For example, the beverage liquid can be provided in a cooled or semi-cooled state and the chilling module 254 can include a cooling jacket or another system that substantially prevents the beverage liquid from increasing to an ambient temperature during the filling processes. In some cases, the chilling module 254 more actively controls the temperature of the beverage liquid, including reducing or maintaining a reduced temperature of the beverage liquid to below a flash point of the beverage liquid, which can be 1° C., 2° C., or 3° C., or more below the flash point temperature of the beverage liquid, as appropriate for a given application and modifiable based on a type of beverage liquid being dispensed.

The ventilation module 258 can operate to reduce beverage liquid vapors levels within an environment of the filling line. As such, combustible vapors can be broadly diluted or otherwise exchange for non-combustible vapors. For example, the ventilation module 258 can include various fans, exhaust components, systems, and so on, which force air away from the beverage containers, and filling equipment of the filling station. Such an air exchange can help reduce the possibility of a combustible environment in an area of the production line. The ventilation module 258 can also help remove the buildup of any volatile vapors and compounds from the area of the filling line.

The capture module 262 can generally be configured to capture stray liquids such as the alcohol products that are produced in conjunction with the dispensing of the alcohol product into the beverage container. The capture module 262 can include a pan, a tray, a basin, and so on that collects the stray fluids and optionally directs the stray liquids to a contained area. The capture module 262 can also operate to flush the stray liquids from an environment associated with the filling line. For example, various sensor can operate to detect a level (or a presence) of the stray liquids. Upon detection of a threshold amount, the capture module 262 can operate to flush (with water, or other liquid) the stray liquids from the capture module 262, such as to a waste receptacle for subsequent disposal.

Figure 3:
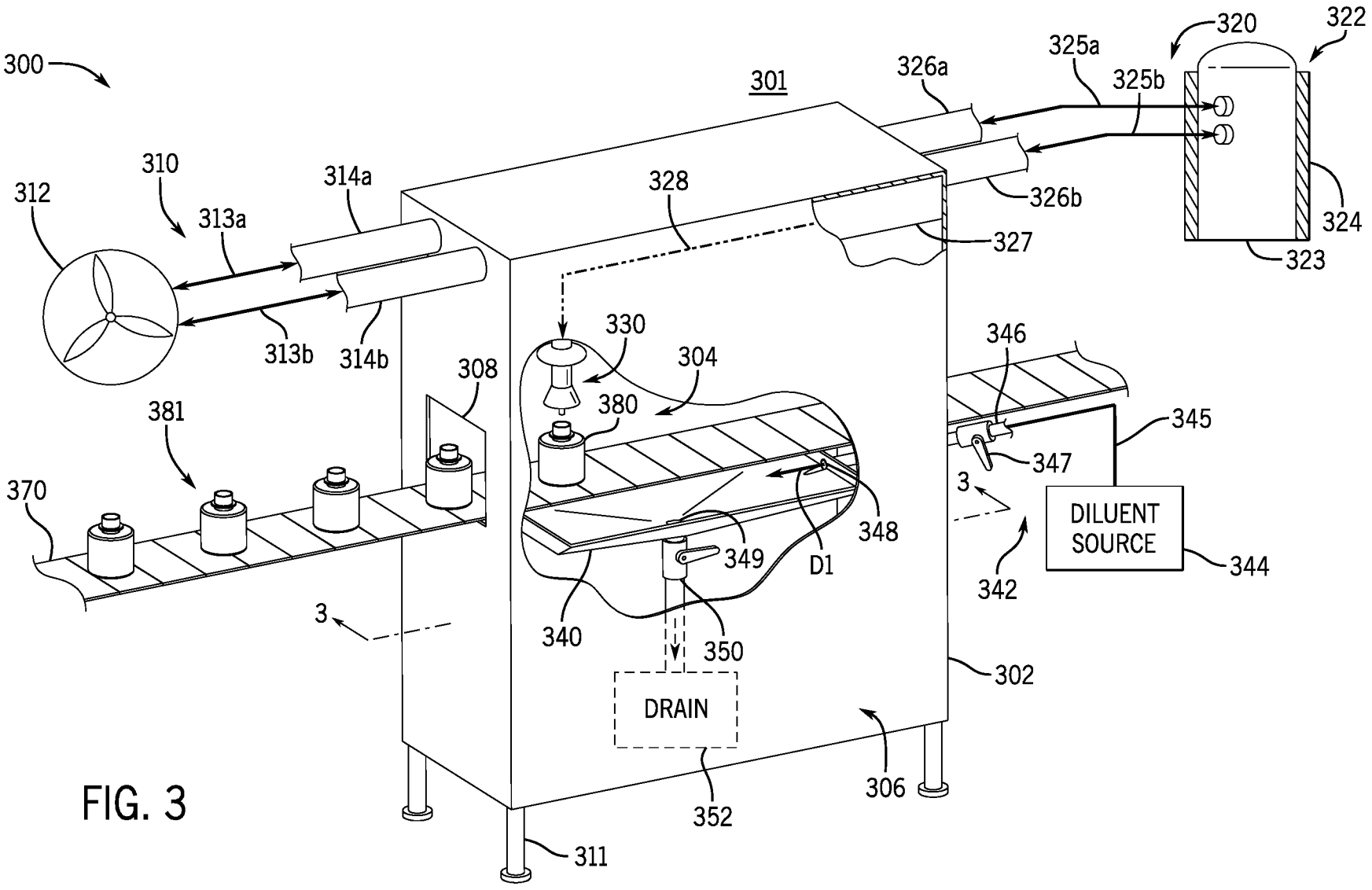
FIG. 3 depicts an example of the filling system of FIG. 2.

FIG. 3 depicts an example of a system of the present disclosure for inducing a non-hazardous zone encompassing a beverage container during filling. For example, FIG. 3 presents certain electrical and mechanical components that can facilitate one or more or all of the functions of the system 200 described with respect to FIG. 2, or any of the systems, fillings systems, and variations thereof described herein.

In this regard, FIG. 3 presents a system 300. The system 300 is used to fill a beverage container 380 of an assembly of beverage containers 381 with a beverage liquid. The beverage liquid can be a combustible liquid, such as an alcohol product, as described herein. The system 300 generally operates to define a non-hazardous zone encompassing the beverage container 380 when the beverage container 380 is being filled with the beverage liquid. The non-hazardous zone can continue to encompass the beverage container during other production steps, such as a rinsing step, a gas blanketing or purge step, a sealing step, a labeling step, and so on, as can be appropriate for a given application.

To facilitate the foregoing, the system 300 includes an enclosure 302. The enclosure 302 can define an atmosphere 304 therein. The atmosphere 304 can be an internal volume of the enclosure 302, within which the assembly of beverage containers 381 can progress into and through so that the beverage container 380 can be filled substantially within the atmosphere 304. As described herein, the multi-tiered approach to hazard reduction can be used to reduce the combustibility of the atmosphere 304 in order to define some or all of the atmosphere 304 as a substantially non-hazardous zone.

The enclosure 302 can, in certain examples, define a barrier between the atmosphere 304 and an external environment 301. The external environment 301 can be an environment that is outside of the enclosure 302, such as that within a manufacturing facility. The barrier defined by the enclosure 302 can help contain vapors and spills associated with the beverage liquid to a defined volume, such as the atmosphere 304, so that the vapors and spills can be mitigated by the systems described herein. The enclosure 302 also demarcates the non-hazardous zone from other equipment and process within the external environment 301, which may or may not be related to beverage production or filling, allowing for unrated electrical components to operate in the external environment 301, as appropriate for a given application.

The enclosure 302 is shown as including sidewalls 306 that cooperate to substantially separate the atmosphere 304 from the external environment 301. The sidewalls 306 can define an entry 308 through which the assembly of beverage containers 381 enter the atmosphere 304 for filling with the beverage liquid. For example, the system 300 can include a conveyance mechanism 370, such as those described herein, that is operable to advance the assembly of beverage containers 381 through the entry 308 and into the atmosphere 304 for filling. In some cases, other doors, entry, widows, or transparent ports can be defined by the sidewalls 306. The enclosure 302 is also shown in FIG. 3 as including supports 311. The supports 311 can structurally support the enclosure 302 within the external environment 301, such as supporting the enclosure 302 within a plant or other operating facility. In some cases, the supports 311 can operate to facilitate the transport of the enclosure 302 to different locations in a manufacturing facility and/or moving to different facilities.

The system 300 can operate to define the atmosphere 304 as a substantially non-hazardous zone within the enclosure 302. For example, the system 300 can employ a ventilation module (e.g., ventilation module 258 of FIG. 2) to dilute vapors within the atmosphere 304. Further, the system 300 can employ a chilling module (e.g., chilling module 254 of FIG. 2) to reduce or maintain a reduced temperature of the beverage liquid within the atmosphere 304. Further, the system 300 can employ a capture module (e.g., capture module 262 of FIG. 2) to dilute stray beverage liquid within the enclosure 302, moving the stray beverage liquid away from the beverage container 380. These systems provide a combinative affect to reduce the combustibility of the atmosphere 304.

In one implementation, the system 300 can employ a ventilation module including an air circulation system 310. The air circulation system 310 can operate to move air into and out of the enclosure 302. As such, the air circulation system 310 can dilute vapors with the atmosphere 304, mitigating potential buildup of vapors therein, which would otherwise contribute to a combustible environment. While it will be appreciated that the air circulation system 310 can include many components to facilitate the described dilution, FIG. 3 shows the air circulation system 310 as including an air circulation component 312. The air circulation component 312 can be a fan or another device capable of delivering a forced air exchanged. The air circulation component 312 is shown remote from the enclosure 302 in FIG. 3; however, in other cases, the air circulation component 312 can be integrated directly with the enclosure 302 itself. Where external to the enclosure 302, air circulation paths 313*a*, 313*b* can be defined between the air circulation component 312 and ducts 314*a*, 314*b* of the enclosure 302. The ducts 314*a*, 314*b* can be inlet and outlet paths that are fluidically coupled with the atmosphere 304. The circulation paths 313*a*, 313*b* can be directly associated with the ducts 314*a*, 314*b*; however, this is not required. For example, the air circulation component 312 can optionally be used to provide ventilation to other components in the external environment 301, such as other components in a manufacturing facility, and the circulation paths 313*a*, 313*b* can provide a fluidic connection between air circulation component 312 and the ducts 314*a*, 314*b* for air exchange.

The system 300 can also employ a chilling module including components that collectively can operate to reduce or maintain a reduced temperature of a beverage liquid, such to a temperature that is below a flash point of the liquid. FIG. 3 provides various illustrations of such components which can be optionally used individually or together in controlling the liquid temperature. For example, the system 300 can include a beverage liquid supply system 320. The beverage liquid supply system 320 can house one or more beverage liquids that are used by a filling station 330 to fill the assembly of beverage containers 381. The beverage liquid supply system 320 can house a sufficient quantity of beverage liquid to fill a substantial quantity of beverage containers, such as filling thousands of beverage containers during the course of a production run. The beverage liquid supply system 320 can thus be remote or external to the enclosure 302, as shown in FIG. 3.

The beverage liquid supply system 320 can include one or more liquid storages 322. The liquid storages 322 can hold the beverage liquid prior to transport to the enclosure 302 for filling, such example in a supply container 323. In some cases, the supply container 323 can be cooled in order to maintain the beverage liquid held therein to below a flash point temperature. In this regard, FIG. 3 shows a cooling jacket 324 positioned around a portion of the supply container 323 in order to provide active cooling to the beverage liquid held therein. As such, the beverage liquid can be transported to the enclosure 302 at a reduced temperature in order to reduce the risk of combustion during filling of the beverage container 380.

In the illustration of FIG. 3, the beverage liquid storage 322 can be fluidically coupled with the enclosure 302 via beverage liquid paths 325*a*, 325*b*. The beverage liquid paths 325*a*, 325*b* can be fluidically coupled to beverage liquid conduits 326*a*, 326*b* which allow the beverage liquid to be introduced into one or more components within the enclosure 302 that facilitate filling the beverage liquid into the beverage container 380. It will be appreciated that the beverage liquid paths 325*a*, 325*b* are presented for purposes of illustration. Rather than necessarily indicative of direct paths, the beverage liquid paths 325*a*, 325*b* can direct the beverage liquid to other processing components, including other pumps, vessels, meters, and so on to facilitate filling, including routing the beverage liquid to certain valves and mixers to combine the beverage liquid with other substances prior to filling the beverage container.

In some cases, the system 300 can operate to reduce or maintain a reduced temperature of the beverage liquid within the enclosure 302. For example, the chilling module can include certain thermal jackets, chillers, condensers, and so on arranged within or partially within the enclosure 302. In this regard, the beverage liquid can be substantially prevented from rising in temperature above a flash point temperature when being dispensed into the beverage container 380. To illustrate, FIG. 3 shows the beverage liquid conduits 326*a*, 326*b* fluidically connected to a cooling mechanism 327. The cooling mechanism 327 can include a heat exchanger that remove heat from the beverage liquid as it enters the enclosure 302, including using active cooling components. In a cooled or semi-cooled state, the beverage liquid can proceed from the cooling mechanism 327 along a beverage liquid flow path 328. In some cases, additional cooling can occur along the flow path 328 as the beverage liquid moves toward the filling station 330. The beverage liquid is then dispensed in the beverage container 380 from the filling station 330.

The system 300 can also employ a capture module including components that can collectively operate to capture, dilute and remove spills of the beverage liquid or other stray liquids from the enclosure 302. FIG. 3 provides various illustration of such components which can be optionally used individually or together in performing these functions. For example, FIG. 3 shows a catch 340 arranged generally below the filling station 330 and the beverage container 380. The catch 340 can be a pan, linear sink, or other structure that can collect stray beverage liquid within the enclosure 302. For example, beverage liquid can spill during filling, and/or more generally, at least some of the beverage liquid emitted from the filling nozzle may not travel to within the beverage container 380. As such, the catch 340 allows such stray beverage liquid to be collected in a common location. The catch 340 also helps define barrier or shield between the stray liquid and other components of the system 300, including electrical components of the system 300 which can be arranged below the beverage container 380, such as being arranged below the conveyance mechanism 370.

The system 300 can also include a flush 342 to generally dilute the stray beverage liquids that are captured within the catch 340. For example, the flush 342 can include a diluent source 344, such as water, that is routable in a controlled manner into a volume defined by the catch 340. For example, the diluent source 344 can be fluidically couplable to the catch via a diluent path 345 that feeds into a diluent conduit 346 that can be fluidically couplable to the catch 340. In some cases, a valve 347 can be arranged along the diluent conduit 346 and/or the diluent path 345 to help meter and control a quantity of diluent that is added to the catch 340. As explained in greater detail with respect to FIG. 4, the valve 347 or other fluid control device can be used to initiate a flow of the diluent upon a detection of the stray fluid in the catch 340, in certain examples.

FIG. 3 further shows an example implementation in which the diluent enters the catch at an opening 348. The diluent can enter the catch at the opening 348 and along a flow path $D_1$. Upon entry, the diluent can interact with any stray fluids in the catch 340 so that the stray fluids are diluted, thereby reducing a risk of combustion with the enclosure 302. The catch 340 can generally define an exit 349 for the combination of diluent and stray beverage liquid, allowing the combination to be routed away from the enclosure 302 for further processing. In some cases, the exit of the combination of diluent and stray beverage liquid from the catch 340 can be facilitated by the operation of one or more exit control valves 350. A drain 352 can be coupled to the exit 349, and provide for the disposal of the fluids away from the enclosure 302.

Figure 4:
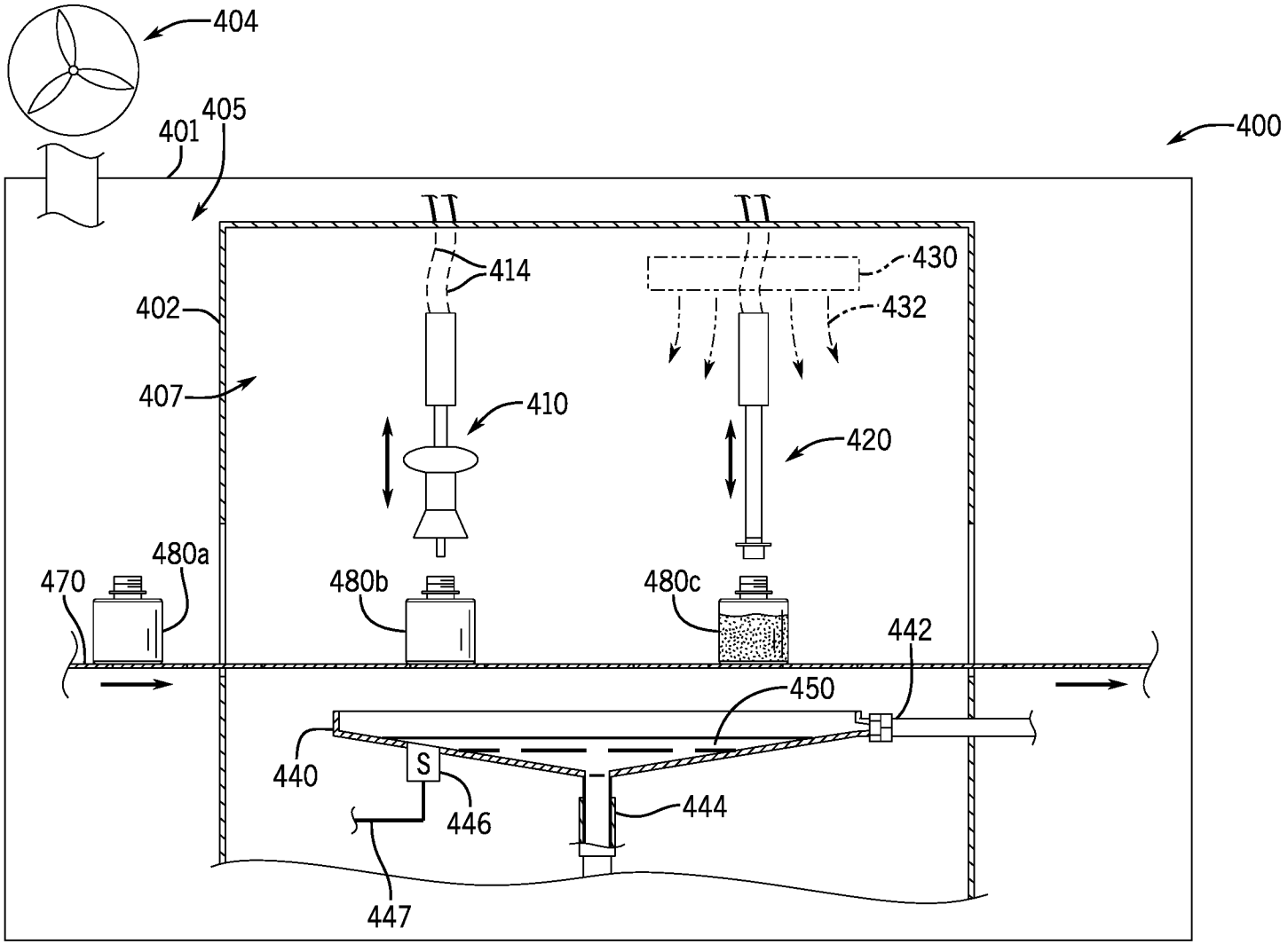
FIG. 4 depicts a schematic representation of another example of the filling system of FIG. 2.

FIG. 4 depicts a schematic representation of a system 400 that is operable to induce a non-hazardous environment encompassing the beverage container. The system 400 can be substantially analogous to the system 200 of FIG. 2 and/or the system 300 of FIG. 3, and can include: an enclosure 402; a filling station 410; a conveyance mechanism 470; beverage containers 480*a*, 480*b*, 480*c*; a catch 440; a flush 442; and a drain 444; redundant explanation of which is omitted here for clarity.

FIG. 4 shows the enclosure 402 within a room 401. The room 401 can be an indoors location within a manufacturing or processing facility, such as one engaged in the production of beverages. The enclosure 402 operates to define a substantially non-hazardous zone encompassing the beverage containers during filling. The non-hazardous zone is separated from other portions of the room 401, which could include other manufacturing or processing components. For example, the enclosure 402 can define an atmosphere 407 proximate to or about the beverage container during filling. The enclosure 402 defines a barrier or shield between the atmosphere 407 and an external environment 405 of the room 401.

As such, the multi-tiered combustion reduction systems and techniques described herein can operate to reduce potential combustion risks within the atmosphere 407. This can allow the external environment 405 to remain untreated or unmitigated. This can be beneficial so as to only apply hazard-mitigation techniques to the location around the beverage container, as opposed to the entire volume defined by the external environment 405. For example, unrated electrical components, machines and so forth can operate safely within the external environment 405, notwithstanding the combustible materials situated within the atmosphere 407. In some cases, an external ventilation component 404 can be provided to ventilate the external environment 405.

In addition to the filling station 410, various other components and systems can be installed within the enclosure 402 to facilitate the filling and more generally production of the beverage containers. Some or all of these components can include electrical components, which according to the examples of the present disclosure, can be unrated for use in a hazardous area. By way of example, FIG. 4 depicts a capping station 420. The capping station 420 can operate to seal the beverage container 480 upon the beverage container being filled with the beverage liquid. The capping station 420 can be arranged at least partially or fully within the enclosure 402 because the beverage liquid of the beverage container 480 remains exposed to the atmosphere 407 until the beverage container 480 is sealed. While many configurations are possible, the capping station 420 can include an arm that advances generally axially toward a beverage container 480 that is arranged below the capping station 420. This advancement can be used to arrange a plug, a stop, a seal, or another component along an opening of the beverage container to form a temporary or permanent seal of the beverage container 480 before the beverage container 480 exits the enclosure 404.

As another example of components included within or partially within the enclosure, a gas blanketing system 430 is shown in FIG. 4. The gas blanketing system 430 is functionally shown in FIG. 4 and can be arranged at any appropriate location within the enclosure 402. Broadly, the gas blanketing system 430 can be used to conduct an oxygen purge of the beverage container 480. This can enhance the product quality, for example, in order to reduce the risk of spoilage of the product. In this regard, the gas blanketing system 430 can introduce $CO_2$ or other gas 432 into the beverage container before, during, and/or after introduction of the beverage liquid into the container. In other examples, other systems can be installed within the enclosure 402 that facilitate the filling and production of the beverage container, including cleaning systems, labeling systems, other filling and sealing system, and so on as can be required for a particular application.

The filling station 410, the capping station 420 and other stations and components of the enclosure 404 can require electrical components and/or an electrical connection to operate. Because the enclosure 402 defines the atmosphere 407 as being substantially non-hazardous, such electrical components can be unrated for a hazardous area. Further, as depicted in FIG. 4, electrical connections that traverse the enclosure 402, such as traversing from the atmosphere 407 to the external environment 405, do not need to change electrical classifications and/or require different protections on either sides of the enclosure 402. For example, FIG. 4 shows electrical connections 414 that can operate to electrically connect components within the enclosure 402 to those outside of the enclosure 402. The electrical connections 414 are shown in phantom line inside of the atmosphere 407 and in solid line inside the external environment 405. According to the systems and techniques described herein, both the phantom line portion and the solid line portion of the electrical connections 414 can have the same unrated or non-hazardous area classification, despite the phantom line portions being with an atmosphere adjacent the beverage container 480 and the beverage liquid.

FIG. 4 also shows that at least some aspects of the combustible atmosphere reduction can be facilitated or actuated in response to real time conditions within the enclosure 402. As one example, the enclosure includes the catch 440 that operates to collect and dilute stray beverage liquids associated with the filling of the beverage container 480. The catch 440 can be coupled with a sensor 446, which can be communicatively coupled via a link 447 to remote processing elements, such as a computer. The sensor 446 can operate to detect a quantity of stray liquid 450 collected by the catch 440. When the stray liquid 450 reaches a threshold amount, the sensor 446 can trigger the flush 442 to deliver a quantity of diluent to the stray liquid 450. This in turn can cause the diluent to interact with and dilute the stray beverage liquid 450, helping t reduce the risk of combustion. The combination of diluent and stray beverage liquid can in turn be moved away from and out of the enclosure 402 via the drain 444.

Figure 5:
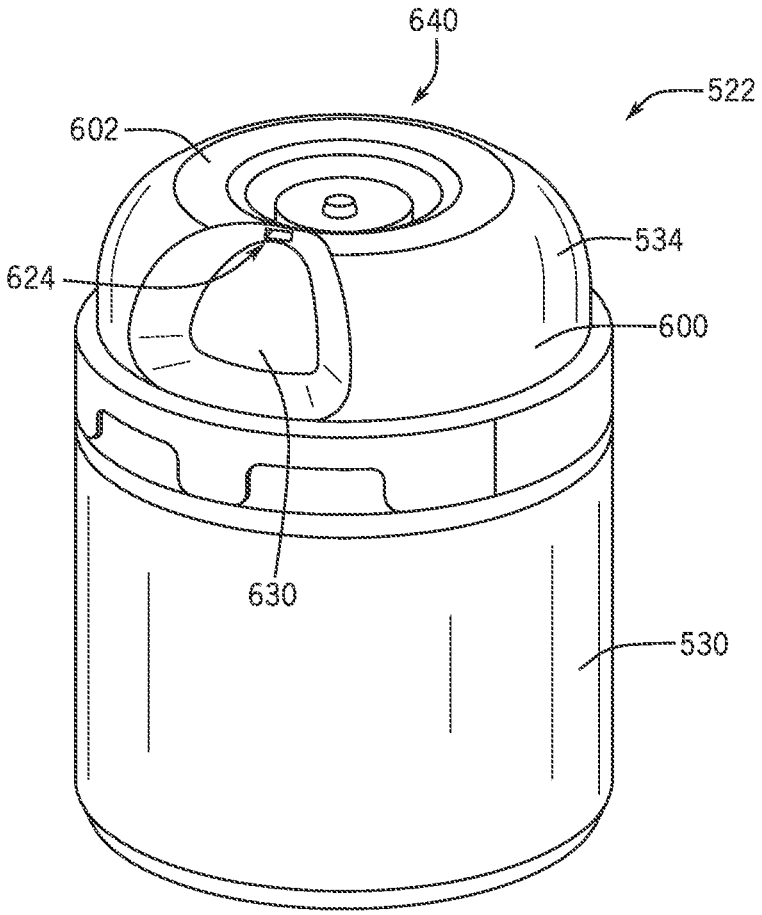
FIG. 5 depicts an isometric view of a beverage container.
Figure 6:
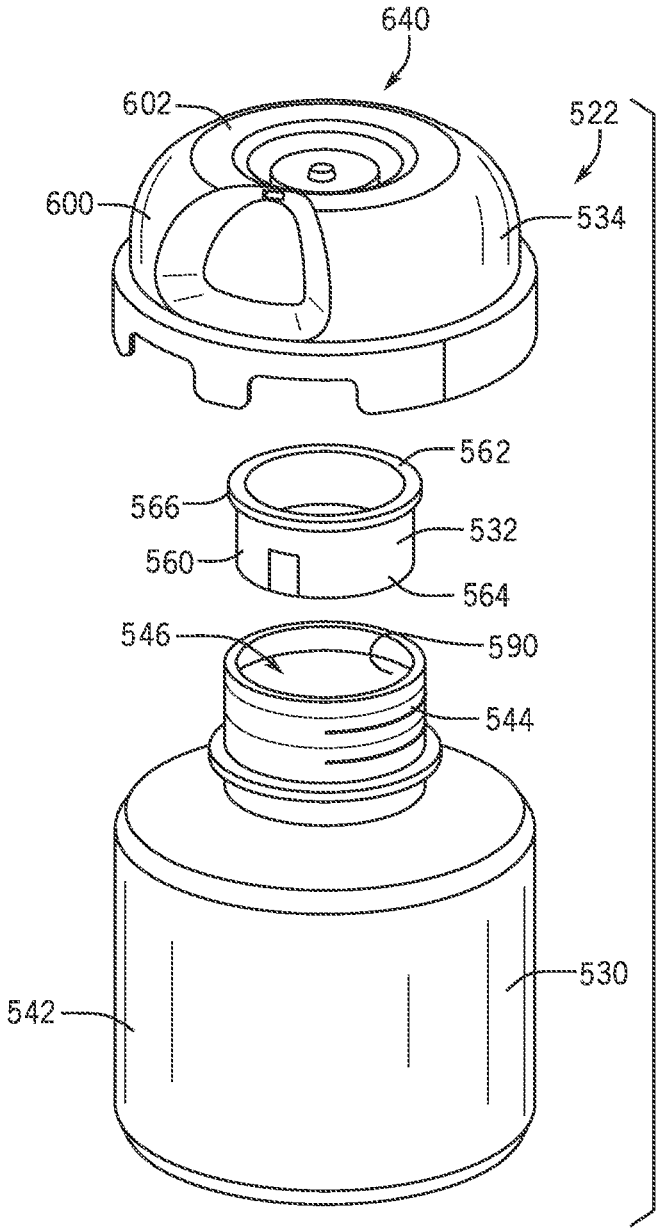
FIG. 6 depicts an exploded view of the beverage container of FIG. 5.

FIGS. 5 and 6 describe an example of a beverage cartridge that can be used with the filling system described herein. With respect to FIG. 5, an isometric view of a beverage container 522 incorporating one or more features of the present disclosure is shown. With respect to FIG. 6, an exploded view is shown of the beverage container 522 of FIG. 5. Referring to FIGS. 5 and 6, the beverage container 522 can include many configurations to dispense a beverage medium contained therein. As noted above, the beverage medium 520 can be dispensed to mix with the precursor liquid to form a beverage. Alternatively, the beverage medium can be dispensed for consumption without dilution or mixing with any other ingredient. As shown in FIGS. 5 and 6, the beverage container 522 includes a container portion 530, a plug 532, and a cap 534. As described herein, the container portion 530 holds the beverage medium. The container portion 530 has an internal space in which the beverage medium is located. The container portion 530, which can be referred to as a bottle or vessel, can include many shapes and arrangements. For instance, the container portion 530 can include a main body portion 542 defining a substantial portion of the internal space. The container portion 530 can include a container flange 544 extending from the main body portion 542. The container flange 544 can define an opening 546 to the internal space. As explained below, the beverage medium can pass through the opening 546 when dispensed from the beverage container 522.

Depending on the particular application, the container flange 544 can include dimensions different than those of the main body portion 542. For example, the container flange 544 can include a height different than the height of the main body portion 542. For instance, the height of the container flange 544 can be less than the height of the main body portion 542, or vice-versa. Additionally or alternatively, the container flange 544 can include a diameter different than a diameter of the main body portion 542, such as the diameter of the container flange 544 being less than the diameter of the main body portion 542, or vice-versa.

With continued reference to FIGS. 5 and 6, the plug 532 can be positioned to cover and/or seal the opening 546 of the container portion 530. The plug 532 can include a cylindrical body 560 defined by a top wall 562 and a sidewall 564 extending therefrom. In some examples, the plug 532 can include an annular plug flange 566 extending radially outward from the sidewall 564 at a distance distal from the top wall 562. The cylindrical body 560 can be shaped to closely fit within the opening 546 of the container portion 530. In this manner, the plug 532 can be positioned at least partially within the opening 546 of the container portion 530. For instance, the cylindrical body 650 can be dimensioned to at least partially extend in close proximity to an inner surface 590 of the container flange 544. In one example, the cylindrical body 560 can be dimensioned to slide smoothly within the opening 546 of the container portion 530. In other examples, the cylindrical body 560 can be dimensioned to frictionally slide against the inner surface 590 of the container flange 544. The engagement between the plug 532 and the container portion 530 can create a sealing effect therebetween to limit or reduce leakage of the beverage medium between the container flange 544 and the plug 532.

The cap 534 can include a gas inlet port 624 arranged to deliver pressurized gas into the internal space of the container 530 to help force the flow of the beverage medium from the beverage container 522. The gas inlet port 624 can be defined adjacent to the bottom flange 602, such as within a recessed scalloped region 630 of the outer portion 600. When the beverage container 522 is positioned within a beverage machine, the gas inlet port 624 can mate with a gas source of the beverage machine to provide pressurized gas to the beverage container 522. The gas can be supplied by a pressurized canister or bottle, such as by the same pressurized canister or bottle supplying gas to carbonate the precursor liquid. The gas can be supplied to the gas inlet port 624 at about 5 psi, such as between 2 psi and 10 psi.

The gas inlet port 624 can be in fluid communication with a lumen of a piercing element. For example, the gas inlet port 624 can be in fluid communication with a cavity 640 defined between the plug 532 and the piercing assembly 640. In such examples, when the piercing element pierces the plug 532, the pressured gas can be delivered into the internal space of the container 530 through the lumen of the piercing element. Depending on the configuration of the piercing element, the pressurized gas can be delivered into the internal space of the container 530 through a side of the piercing element. As the gas enters the container 530, the gas can pressurize the space within the container 530 above the beverage medium. The pressurized space above the beverage medium can force the beverage medium through the lumen of the piercing element and out of the cap 534. In this manner, the beverage container 522 can include a single orifice to pressurize the beverage container 522 and allow the beverage medium to exit the container portion 530. Once the beverage medium exits the cap 534, the beverage medium can be mixed with a carbonated liquid to generate a beverage.

The beverage container 522 can be formed from a variety of materials and by a variety of methods. For example, portions of the beverage container 522 (e.g., the cap 534 and the plug 532) can be formed from a thermoplastic material (self-reinforced or fiber reinforced), HDPE, ABS, polycarbonate, polypropylene, polystyrene, PVC, polyamide, and/or PTFE, among others. In some examples, portions of the beverage container 522 can be formed from aluminum or other similar metal. In some examples, portions of the beverage container 522 (e.g., the container portion 530) can be formed from glass or similar material. Gaskets can be formed from a rubberized material or other suitable material. The materials can be food grade. In some examples, the beverage container 522 can be made of, or otherwise include, materials that provide a barrier to moisture and/or gases, such as oxygen, water vapor, etc. The beverage container 522 can be formed or molded in any suitable manner, such as by plug molding, blow molding, injection molding, casting, or the like.

In accordance with one aspect of the present disclosure, the beverage container 522 can include an indicator that is readable by an indicator reader of a beverage machine. As non-limiting, illustrative examples, the indicator can be an RFID tag, barcode, alphanumeric string, taggant, taggant ink, or other suitable indicator. The indicator can be used to provide any suitable information to the beverage machine or to the user. For example, the indicator can inform the beverage machine of the type of contents contained within the beverage container 522 such as a specific flavor, volume, gas-only, or beverage material-only, which can cause the beverage machine to perform an operation that is suitable for such contents. In some examples, the indicator can provide product authentication, expiration information, and/or manufacturing information, such as lot number and manufacturing facility.

Figure 7:
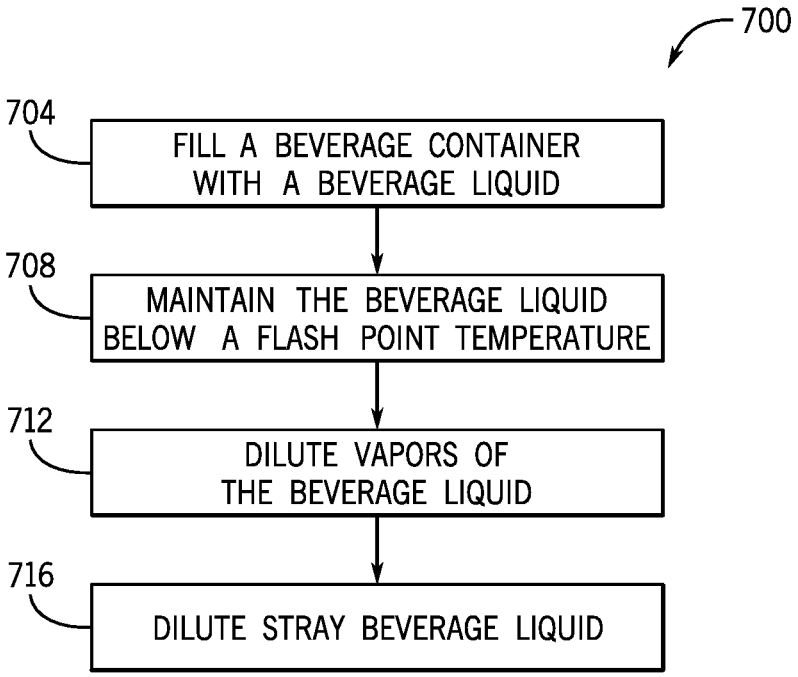
FIG. 7 depicts a flow diagram for inducing a non-hazardous zone encompassing a beverage container.

To facilitate the reader's understanding of the various functionalities of the examples discussed herein, reference is now made to the flow diagram in FIG. 7, which illustrates a process 700. While specific steps (and orders of steps) of the methods presented herein have been illustrated and will be discussed, other methods (including more, fewer, or different steps than those illustrated) consistent with the teachings presented herein are also envisioned and encompassed with the present disclosure.

In this regard, with reference to FIG. 7, process 700 relates generally to a method for providing a combustible beverage liquid to a beverage container. The process 700 can be used with any of the filling systems and beverage containers described herein, for example, such as the filling systems 200, 300, 400 and/or beverage containers 380, 480, 522 and variations and combinations thereof.

At operation 704, a beverage container can be filled with a beverage liquid. For example and with reference to FIGS. 3 and 4, the beverage container 380 can be filled with a beverage liquid, such as any of the beverage liquids described herein. The beverage liquid can be an alcohol product, as described herein. In this regard, the beverage liquid can have an alcohol content of at least 10% ABV, at least 30% ABV, or at least 50% ABV, among other possibilities. The beverage liquid 190 can also be carbonated, such having a carbonation level of at least 1.0 g/L, at least 3.0 g/L, or at least 5.0 g/l, among other possibilities. The beverage liquid can thus be combustible, including having vapors which can ignite, if left unmitigated.

The method 700 operates to mitigate such hazards. In particular, the method 700 operates to induce a non-hazardous zone encompassing the beverage container during the operation 704 of filling. For example, at operation 708, the beverage liquid can be maintained below a flash point temperature. This can be accomplished using a chilling module, such as the various chilling modules and variations thereof described herein. For example, and with reference to FIGS. 2 and 3, the chilling module 254 can be used to reduce or maintain a reduced temperature of the beverage liquid during filling. This can involve engaging one or more external cooling mechanisms, such as the cooling jacket 324, which is shown in FIG. 3 as providing active cooling to the supply container 323 having the beverage liquid. Additionally or alternatively, the operation 708 can involve reducing or maintain a reduced temperature of the beverage liquid during a filling operation, such as within the non-hazardous zone induced by the method 700. This can allow the beverage liquid to be dispensed into a beverage container at or below a flash point of the beverage liquid, including being 1° C., 2° C., 3° C., or more below the flash point temperature of the beverage liquid.

The method 700 can further operate to mitigate such hazards of the beverage liquid by inducing a non-hazardous zone encompassing the beverage liquid via vapor dilution. For example, at operation 712, vapors of the beverage liquid associated with the operation of filling the beverage container can be diluted. This can be accomplished using a ventilation module, such as the various ventilation modules and variations thereof described herein. For example and with reference to FIGS. 2 and 3, the ventilation module 258 can operate to dilute vapors that can be produced from the beverage liquid. This can involve engaging one or more air circulation systems and components, such as the illustrative air circulation system 310 and the air circulation component 312 shown in FIG. 3. The air circulation component 312 can include a fan or other device to exchange and move air within the enclosure 302 of FIG. 3. As such, vapor buildup with the enclosure 302 can be forced from the enclosure 302 and away from any electrical components of the system, thus mitigating risk of combustion.

The method 700 can further operate to mitigate such hazards of the beverage liquid by inducing a non-hazardous zone encompassing the beverage liquid via stray beverage liquid capture and dilution. For example, at operation 716, stray beverage liquid associated with the operation of filling the beverage container can be diluted. This can be accomplished using a capture module, such as the various capture modules and variations thereof described herein. For example, and with references to FIGS. 2 and 3, the capture module 262 can operate to capture spill, stray, or generally excess beverage liquid resulting from the beverage filling process. This can involve engaging one or more catches, pans, or trays and associated system to diluent buildup of the stray beverage liquid captured therein, such as the catch 340 and/or the flush 342 of FIG. 3. For example, the catch 340 at the operation 716 can collect beverage liquid that does not adequately arrive in the beverage container 380 during filling. The flush 342 can provide a diluent, such as water, to the catch 340 in order to interact with the stray beverage liquid, forming a diluted combination of the stray beverage liquid that can be readily removed from the system 300, such as being directed away from the assembly of beverage containers 381 and/or away from other aspects of the filling.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and Band C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A system for providing a combustible beverage liquid to a beverage container, comprising:

a ventilation module configured to dilute vapors of the beverage liquid, the ventilation module comprising an enclosure;

a chilling module configured to reduce or maintain a reduced temperature of the beverage liquid within the enclosure;

a filling module configured to fill the beverage container with the combustible liquid within the enclosure;

a capture module configured to dilute stray beverage liquid within the enclosure;

wherein the ventilation module, the chilling module, the filling module, and the capture module cooperate to define a non-hazardous zone encompassing the beverage container; and wherein the capture module comprises, within the enclosure: a catch configured to collect the stray beverage liquid;

a flush adapted to provide a diluent to the catch for diluting the stray beverage liquid; and an exit for removing a combination of the diluent and the stray beverage liquid from the non-hazardous zone.

2. The system of claim 1, further comprising electrical components exposed to an atmosphere associated with the beverage liquid within the non-hazardous zone.

3. The system of claim 2, wherein the electrical components are unrated for use in a classified hazardous area location.

4. The system of claim 1, wherein vapors associated with the beverage liquid or stray beverage liquid are maintained at a concentration below a lower flammability level of said vapors.

5. The system of claim 4, wherein the concentration is a concentration of at least 25% below the lower flammability level.

6. The system of claim 1, wherein the beverage liquid comprises an alcohol product having an alcohol concentration of less than 50% ABV.

7. The system of claim 1, wherein the beverage liquid comprises a carbonated product having a carbonation level of less than 5.0 g/L.

8. The system of claim 1, wherein the ventilation module comprises an air circulation system fluidically coupled with the enclosure adapted to remove vapors from the enclosure.

9. The system of claim 8, wherein the filling station is adapted to provide the beverage liquid to the beverage container at the reduced temperature.

10. The system of claim 9, wherein the reduced temperature of the beverage liquid is below a flash point temperature of the beverage liquid.

11. A method for providing a combustible beverage liquid to a beverage container, comprising:

filling the beverage container, within an enclosure, with the combustible beverage liquid; and inducing a non-hazardous zone within the enclosure and encompassing the beverage container during the operation of filling by:

maintaining the beverage liquid at a temperature below a flash point temperature of the beverage liquid using a chilling module configured to reduce or maintain a reduced temperature of the beverage liquid within the enclosure; diluting vapors of the beverage liquid associated with the operation of filling the beverage container using a ventilation module configured to dilute vapors of the beverage liquid within the enclosure;

diluting stray beverage liquid associated with the operation of filling the beverage container using a capture module configured to dilute stray beverage liquid within the enclosure; and wherein the capture module comprises, within the enclosure: a catch configured to collect the stray beverage liquid;

a flush adapted to provide a diluent to the catch for diluting the stray beverage liquid; and an exit for removing a combination of the diluent and the stray beverage liquid from the non-hazardous zone.

12. The method of claim 11, further comprising providing the beverage container, the beverage container having a volume of less than 350 ml.

13. The method of claim 11, further comprising sealing the beverage liquid within the beverage container within the non-hazardous zone.

14. The method of claim 11, further comprising operating one or more unrated electrical components proximate the beverage container during the operation of filling.

15. The method of claim 11, wherein the beverage liquid comprises one or both of a beer concentrate or a cocktail concentrate.

16. The method of claim 11, wherein the operation of diluting vapors comprises inducing air flow traversing the beverage liquid during the operation of filling and adapted to carry the vapors away from the beverage container.

17. The method of claim 11, wherein the operation of diluting the stray beverage liquid comprises inducing a liquid flow traversing a catch below the beverage container and having the liquid flow adapted to carry the stray beverage liquid away from the beverage container.

18. A system for providing a combustible beverage liquid to a beverage container, comprising:

an enclosure adapted for forced ventilation and stray fluid exit;

a conveyance mechanism configured to route an assembly of beverage containers through the enclosure;

a filling station within the enclosure and configured to provide the beverage liquid to a beverage container of the assembly at or below a flash point temperature of the beverage liquid;

a capping station within the enclosure and configured to seal the beverage liquid within the beverage container; and electrical components at least partially within the enclosure and exposed to a common atmosphere associated with the filling station and the capping station.

19. The system of claim 18, further comprising an air circulation system fluidically coupled with the enclosure for providing the forced ventilation and configured to dilute vapors of the beverage liquid within the enclosure.

20. The system of claim 18, further comprising a catch generally arranged below the conveyance mechanism and configured to collect stray beverage liquid.

21. The system of claim 20, further comprising a flush configured to provide a diluent to the catch upon the collection of stray beverage liquid therein, the catch fluidically coupled to the stray fluid exit of the enclosure.

22. The system of claim 21, wherein the electrical components comprise a sensor configured to detect a collection of the stray beverage liquid within the catch.

23. The system of claim 21, wherein the electrical components comprise a mass flow meter configured to meter the beverage liquid into the beverage container.

24. The system of claim 18, further comprising, within the enclosure, a gas blanketing system configured to displace oxygen encompassing or within the beverage container.

* * * * *